US011447209B2

(12) United States Patent
Brink

(10) Patent No.: US 11,447,209 B2
(45) Date of Patent: Sep. 20, 2022

(54) RECOVERY APPARATUS AND ALLOCATED METHOD

(71) Applicant: FRAUNHOFER-GESELLSCHAFT ZUR FOERDERUNG DER ANGEWANDTEN FORSCHUNG E.V., Munich (DE)

(72) Inventor: Gunnar Brink, Karlsruhe (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 16/408,857

(22) Filed: May 10, 2019

(65) Prior Publication Data

US 2019/0263481 A1 Aug. 29, 2019

Related U.S. Application Data

(63) Continuation of application No. PCT/EP2017/063513, filed on Jun. 2, 2017.

(30) Foreign Application Priority Data

Nov. 11, 2016 (DE) ..... 10 2016 222 225.2

(51) Int. Cl.
*B63B 27/16* (2006.01)
*B63G 8/00* (2006.01)
(Continued)

(52) U.S. Cl.
CPC ..... *B63B 27/16* (2013.01); *B63B 21/56* (2013.01); *B63B 2027/165* (2013.01);
(Continued)

(58) Field of Classification Search
CPC ... B63B 27/16; B63B 21/56; B63B 2035/007; B63B 2027/165; B63G 2008/004; B63G 2008/008
See application file for complete search history.

(56) References Cited

U.S. PATENT DOCUMENTS 3,448,712 A 6/1969 Lehmann et al.
4,021,589 A 5/1977 Copley
(Continued)

FOREIGN PATENT DOCUMENTS

DE 33583 A 11/1964
DE 202004019088 U1 3/2005
(Continued)

OTHER PUBLICATIONS

ISA/EP, International Search Report and Written Opinion (with English translation), dated Sep. 27, 2017, re PCT International Patent Application No. PCT/EP2017/063513.
(Continued)

*Primary Examiner* — Anthony D Wiest
(74) *Attorney, Agent, or Firm* — Perry + Currier Inc.

(57) ABSTRACT

A remote-controlled, semi-autonomous or autonomous recovery apparatus includes a drive as well as a unit for launch and recovery of an autonomous underwater vehicle. The drive is dimensioned such that a large range, such as more than 5 nautical miles, is obtained.

13 Claims, 12 Drawing Sheets

(51) Int. Cl.
*B63B 35/00* (2020.01)
*B63B 21/56* (2006.01)

(52) U.S. Cl.
CPC .. *B63B 2035/007* (2013.01); *B63G 2008/004* (2013.01); *B63G 2008/008* (2013.01)

(56) References Cited

U.S. PATENT DOCUMENTS

| | | | | |
|---|---|---|---|---|
| 4,545,315 | A | 10/1985 | Becherer | |
| 6,153,294 | A | 11/2000 | Patton et al. | |
| 7,854,569 | B1 * | 12/2010 | Stenson | B63G 8/001 405/188 |
| 8,869,726 | B2 * | 10/2014 | Skiadas | B63B 27/36 114/259 |
| 9,669,904 | B2 * | 6/2017 | Hanson | G05D 1/0088 |
| 2001/0023658 | A1 | 9/2001 | McInnes | |
| 2006/0104720 | A1 | 5/2006 | Haski et al. | |
| 2007/0214949 | A1 | 9/2007 | Barton | |
| 2009/0308299 | A1 * | 12/2009 | Luccioni | B63G 8/001 114/230.23 |
| 2010/0018449 | A1 * | 1/2010 | Luccioni | B63G 8/001 114/322 |
| 2012/0160143 | A1 | 6/2012 | Bailey | |
| 2015/0251739 | A1 | 9/2015 | Ryuh | |

FOREIGN PATENT DOCUMENTS

| | | | |
|---|---|---|---|
| DE | 102010003433 | A1 | 10/2011 |
| DE | 102011122533 | A1 | 6/2013 |
| EP | 0883648 | A1 | 12/1998 |
| EP | 1031506 | A2 | 8/2000 |
| EP | 1104388 | B1 | 1/2005 |
| GB | 1177776 | A | 1/1970 |
| GB | 2210838 | A | 6/1989 |
| WO | WO-2005030571 | A2 | 4/2005 |
| WO | WO-2012013171 | A1 | 2/2012 |
| WO | WO-2015063200 | A1 | 5/2015 |

OTHER PUBLICATIONS

"Nereus (Roboter)." Wikipedia, Wikimedia Foundation, Dec. 14, 2018, URL: de.wikipedia.org/wiki/Nereus_(Roboter). [with English version appended].

Bogadtke, E., "Motorkatamaran aus Frankrelch—Neuhelt Lagoon 630 MY," Boote—Motorboot-Magazin, Jan. 17, 2016, Dellus Klasing Verlag. URL: http://www.boote-magazin.de/motorboote/neue_boote/neuhelt-lagoon-630-my/a46963.html#.

Wang. Chao, et al. "Hydrodynamic analysis of a SWATH planing USV based on CFD." Oceans 2016-Shanghai. IEEE, 2016.

* cited by examiner

RECOVERY APPARATUS AND ALLOCATED METHOD

CROSS-REFERENCE TO RELATED APPLICATIONS

This application is a continuation of copending International Application No. PCT/EP2017/063513, filed Jun. 2, 2017, which is incorporated herein by reference in its entirety, and additionally claims priority from German Application No. 10 2016 222 225.2, filed Nov. 11, 2016, which is also incorporated herein by reference in its entirety.

Embodiments of the present invention relate to a recovery apparatus having an increased range. Embodiments relate to a recovery apparatus having a catamaran or SWATH (small water plane area twin hull) form with increased range.

BACKGROUND OF THE INVENTION

SWATH vehicles are discussed, for example, in Wang, C., Y. Lin, Z. Hu, L. Geng and D. Li. "Hydrodynamic Analysis of a Swath Planing Usv Based on Cfd." In OCEANS 2016—Shanghai, 1-4, 2016.

Marine research with submersibles, such as autonomous underwater vehicles (AUV) is ruled by ship costs. Scientific boats and measurement boats are expensive as the same are highly specialized constructions. The cost situation would be improved when common low-cost supply ships could be converted into research ships within a short time. This would increase the pool of available ships and would allow an increase in numbers of AUVs for marine research. Thus, the costs of marine research would be reduced by economically motivated measurement or exploration.

When using AUVs, the launch and recovery system (LARS) used on scientific ships or measurement ships is a further cost driver. Such LARS have their own cranes or ramps that allow recovery at rough swell (e.g., of stage 3, 4 or higher). The costs for such LARS are frequently above one million Euros per system. Further, as already stated, such LARS cannot be used on any ship.

A technically expensive method which is very elaborate for the crew is used in the German Armed Forces. Here, inflatable boats are used for recovering exercise torpedoes.

Here, the bottom of the inflatable boat is under water such that the inflatable boat is open towards the back. Divers mount a rope at the exercise torpedo, by the help of which the exercise torpedo is retracted into the inflatable boat. This approach is quite simple with respect to the used means but causes significant staff expenses. Thus, there is the need for an improved approach.

SUMMARY

According to an embodiment, a recovery apparatus for an autonomous underwater vehicle may have: a drive that is configured to transport the recovery apparatus together with the autonomous underwater vehicle across a large range; means for launch and recovery of the autonomous underwater vehicle, wherein the recovery apparatus is configured to be operated in a remote-controlled, semi-autonomous or autonomous manner.

Embodiments of the present invention provide a remote-controlled semi-autonomous or autonomous recovery apparatus having a drive that is configured to transport the recovery apparatus together with the autonomous underwater vehicle across a large range and means for launch and recovery.

Thus, the core of the present invention is the finding that an autonomous underwater vehicle does not necessarily have to be launched by a mother ship but can also be launched from land. According to one aspect of this invention, a recovery apparatus that has a drive concept for a large range and that is at the same time suitable to transport, launch and recover an autonomous underwater vehicle is used for this. Here, it is advantageous that the autonomous underwater vehicle cannot only operate in the close range around the mother ship but can also be sent off independent of the same across many kilometers/nautical miles from land. Thereby, the usage of cost intensive mother ships can mostly be prevented.

According to embodiments, a large range usually means a range of 500 nautical miles or even 1000 nautical miles. Generally, a large range means at least more than 5 nautical miles or 12 nautical miles or at the least around 5 nautical miles.

According to embodiments, the drive of the recovery apparatus includes either a combustion engine having a sufficiently large fuel tank, e.g., 100 or 500 liter to obtain the large range, or an electric motor, such as shown in FIG. 3*d*, having a sufficiently large battery. As an alternative to a battery, such as shown in FIG. 3*d*, a generator 81, such as shown in FIG. 1*c*, having a respective fuel tank, such as shown in FIG. 3*c*, can be provided. According to a further embodiment, alternatively or additionally to the energy storage, an energy generator 81, such as a solar cell shown in FIG. 1*c*, which generates the energy necessary for transport or generally for operation, can be arranged on the autonomous underwater vehicle.

According to further embodiments, the recovery apparatus includes a control ensuring the autonomous or semi-autonomous operation. This control can also access a sensor system 82, such as shown in FIG. 1*c*, which is also part of the recovery apparatus. This sensor system can, for example, include cameras or position determiners, such as GPS sensors 83, as shown in FIG. 1*c*.

According to further embodiments, the control can be configured to control not only the distance in a semi-autonomous or autonomous manner but can also perform the maneuver such as the docking maneuver. According to further embodiments, the control is also configured, for example when the examination field for the autonomous underwater vehicle is reached, to launch the same autonomously and to recover the same again after the mission has been completed.

According to further embodiments, the recovery apparatus comprises means, such as a fender, so that the recovery apparatus can dock at land, for example at a pier or a mother ship.

According to further embodiments, the autonomous recovery apparatus for the autonomous underwater vehicle serves as charging station. In that way, energy can be retrieved from the autonomous recovery apparatus and can be transferred into the autonomous underwater vehicle such that the same performs several missions successively. Here, the autonomous underwater vehicle cannot only exchange energy but also data with the autonomous underwater vehicle and can transfer the same, for example, to a base station. In that way, the autonomous recovery apparatus forms some sort of repeater, such as on a radio basis, for the autonomous underwater vehicle.

According to further embodiments, the recovery apparatus can include means that allow the improvement of positioning of the AUV, in particular in underwater operation. These are, for example, a transmitter and a receiver, such as shown in FIG. 1*c*, or a so-called hydrophone 83, such as shown in FIG. 1*c*, that transmit, for example, GPS signals underwater. These transmitters and receivers or the hydrophone are disposed below the water surface and allow positioning according to the principle of USBL (ultra-short baseline) or LBL (long baseline) concepts.

According to further embodiments, the recovery apparatus has two hulls (catamaran shape or SWATH shape) and a (fixed) net for receiving an autonomous underwater vehicle. The net can be lowered from a non-lowered state into a lowered state such that the autonomous water vehicle can be received in the lowered state and can be transported in the non-lowered state. The opposite movement from the lowered state to the non-lowered state is then performed during the actual recovery process. This principle offers two essential advantages, namely that the catamaran moves together with waves, whereby an AUV can be recovered securely/reliably even at heavy swell.

According to further embodiments, the net can be lowered or lifted by means of one or several electrical winches/engines so that no additional staff action is needed.

According to further embodiments, the recovery apparatus is extended by a winch for recovering the AUV in the gap between the two hulls. Hooks of the AUV can be hooked into the winch, for example, or on a pop-up nose.

BRIEF DESCRIPTION OF THE DRAWINGS

Embodiments of the present invention will be detailed subsequently referring to the appended drawings, in which.

DETAILED DESCRIPTION OF THE INVENTION

Before embodiments of the present invention will be discussed in detail with reference to the drawings, it should be noted that equal elements and structures are provided with the same reference numbers such that the description of the same is inter-applicable or inter-exchangeable.

Figure 1A:
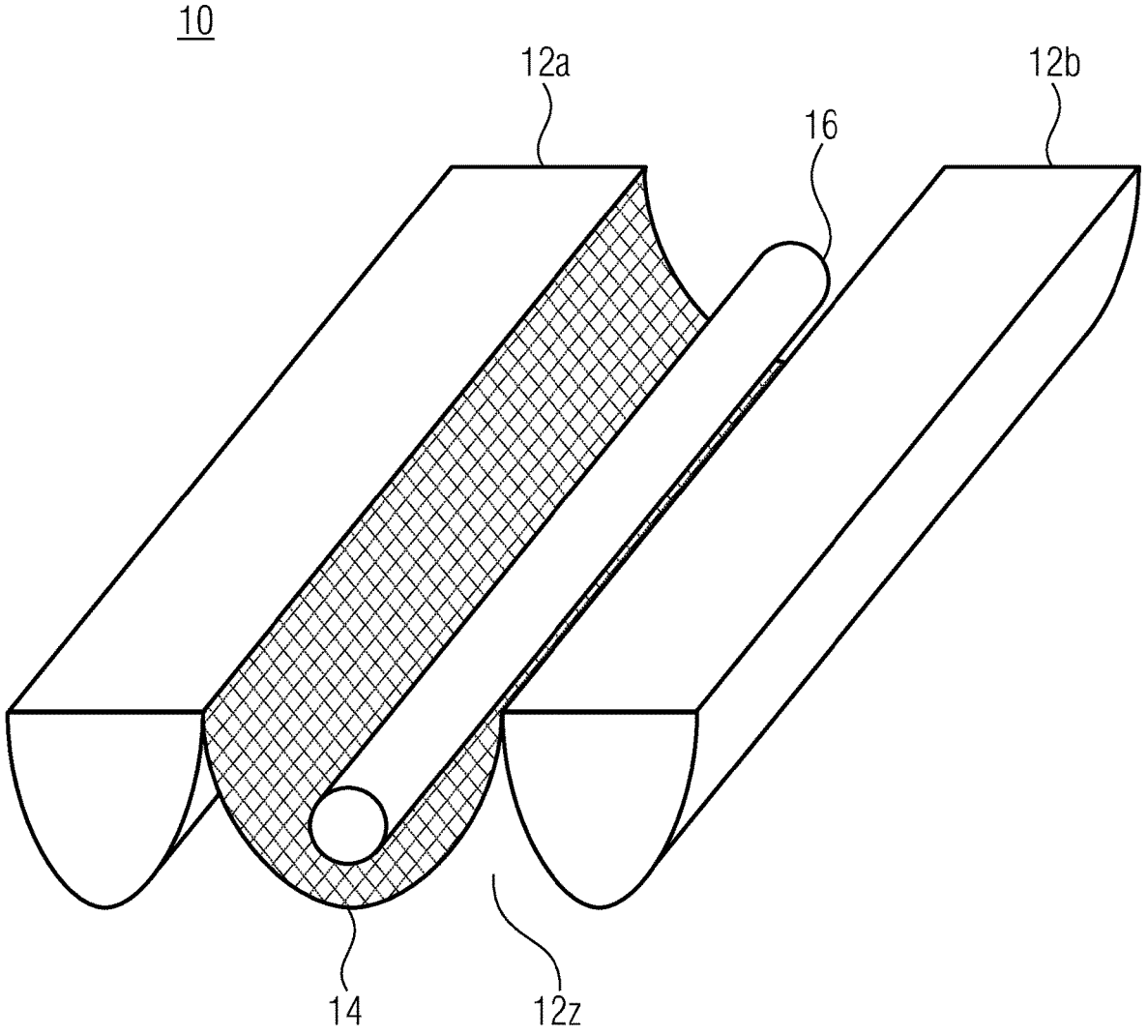
FIG. 1*a* is a schematic illustration of a recovery apparatus according to the basic embodiment.

FIG. 1*a* shows a recovery apparatus 10 in the form of a catamaran having two hulls 12*a* and 12*b* as well as a net 14 for recovering an AUV 16 arranged between the two hulls.

In the catamaran 10, the two hulls 12*a* and 12*b* are essentially arranged in parallel such that a gap 12*z* is formed between the two hulls 12*a* and 12*b*. The AUV 16 can pull into this gap. Here, it should be noted that pulling-in can take place even from the front, i.e., from the bow side or from the rear, i.e., from astern, wherein it is also possible that the gap 12*z* is open to both sides.

Figure 1B:
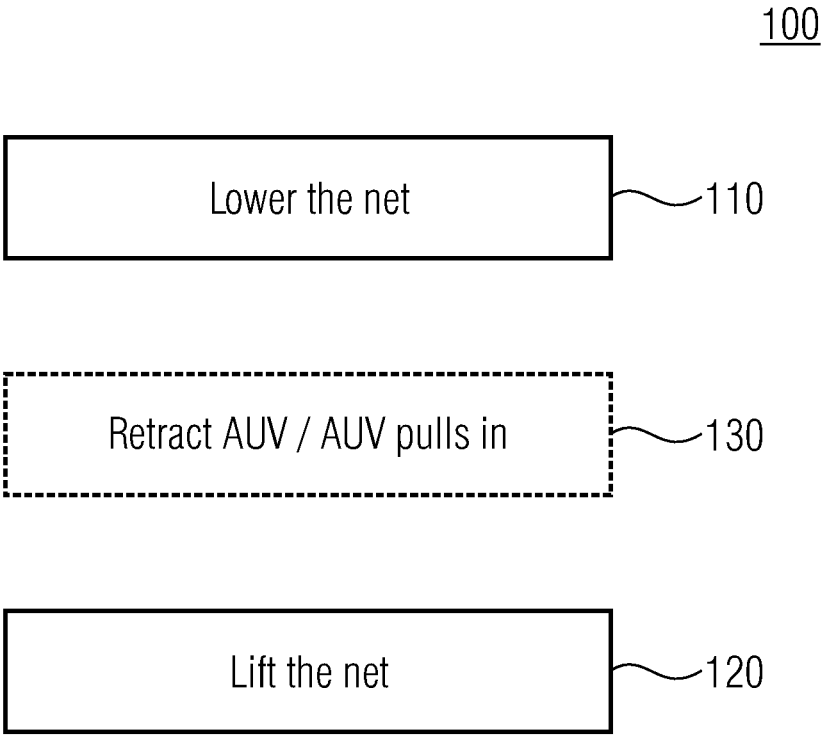
FIG. 1*b* is a schematic flow diagram for illustrating the method during recovery.
Figure 1C:
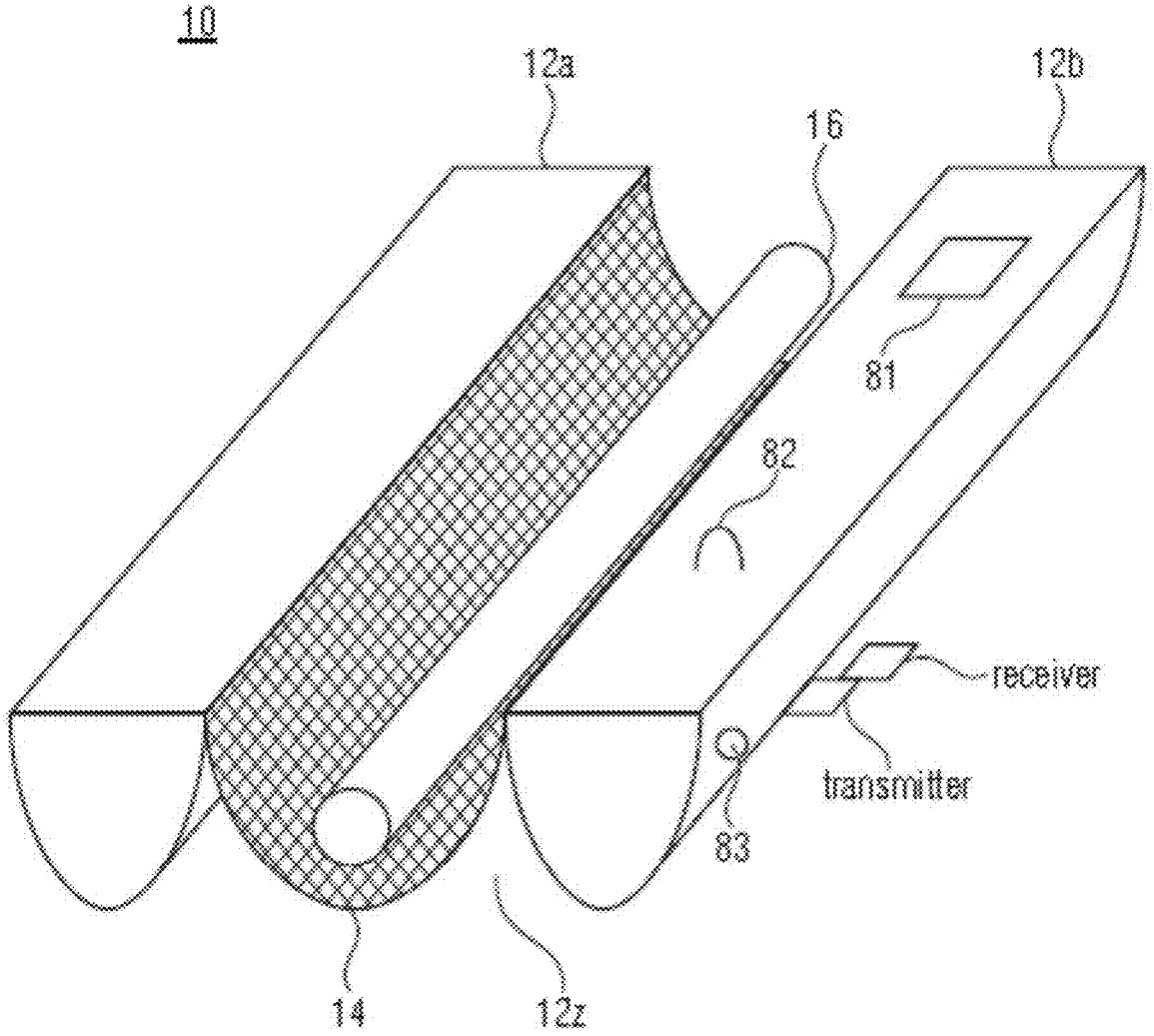
FIG. 1*c* is a schematic illustration of a recovery apparatus according to a further embodiment.

The mode of operation of the recovery apparatus 10 will now be discussed based on the recovery method 100 illustrated in FIG. 1*b*. The following illustration assumes that the net 14 has already been lowered below the water surface (cf. step 110 "lowering the net" of the method illustrated in FIG. 1*b* for "recovering an autonomous underwater vehicle").

When the AUV 16 has pulled into the gap 12*z*, the AUV 16 can be recovered by means of the net 14. For that, the net 14 lowered before is transferred from a lowered position where the net floats below the water surface to a non-lowered position (see for this step 120 "lifting the net 14") where the AUV 16 is then recovered in the net 14. The net can also comprise the optional step of "retracting the AUV" 130 or "AUV pulls in" 130.

For this, according to embodiments, the net 14 extends across the entire gap 12*z*, i.e., from the first hull 12*a* to the second hull 12*a* and also across the entire length of the AUV 16.

The transition from the lowered to the non-lowered position is performed in a motor-driven manner, whereby the AUV is recovered by lifting the net 14.

In this recovered position, the AUV 16 can be transported and then be lowered again into the water at a later time.

Since the recovery apparatus 10 is comparable to the AUV 16 regarding its dimensions, both elements 10 and 16 have similar behavior with regard to the swell. Thus, it is advantageously possible that the AUV 16 can be recovered even at heavy swell. In a subsequent step, the recovery apparatus 10 can be pulled into the mother ship together with the AUV 16. When recovering the catamaran 10, a conventional crane or also a recovery apparatus for an inflatable boat can be used. For this, the catamaran 10 has to be provided either with eyes for hooking-in in the catamaran 10 or also simple engagement areas, such as the bottom of the catamaran 10 via which the recovery means of the mother ship can recover the catamaran 10 together with the AUV 16. Since the AUV 16 is arranged in the gap 12*z* between the two hulls 12*a* and 12*b*, the AUV 16 is protected towards the outside, e.g., against collision with the ship wall.

Figure 2A:
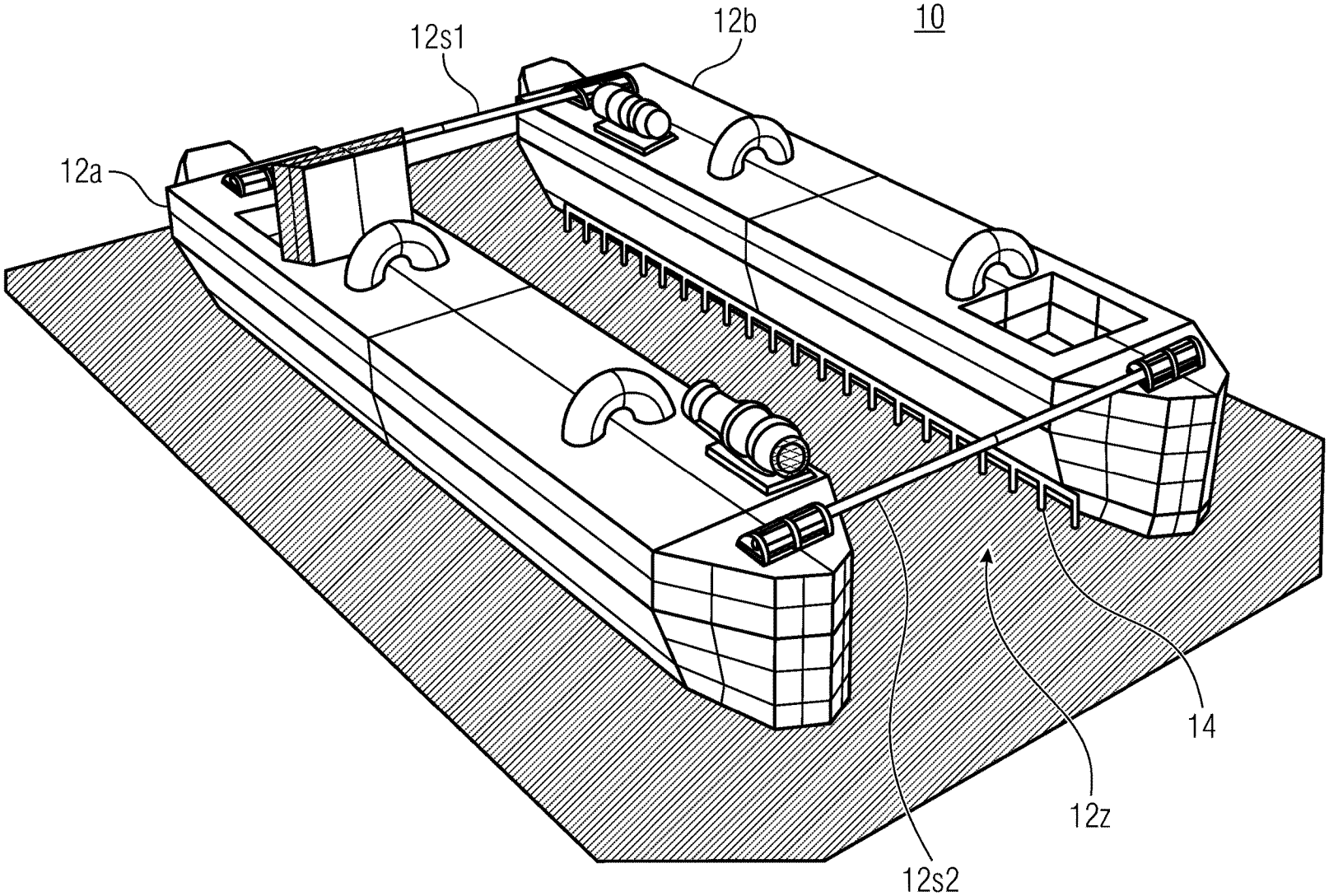
FIGS. 2*a, b* are three-dimensional representations of the recovery apparatus when recovering an underwater vehicle according to extended embodiments.
Figure 2B:
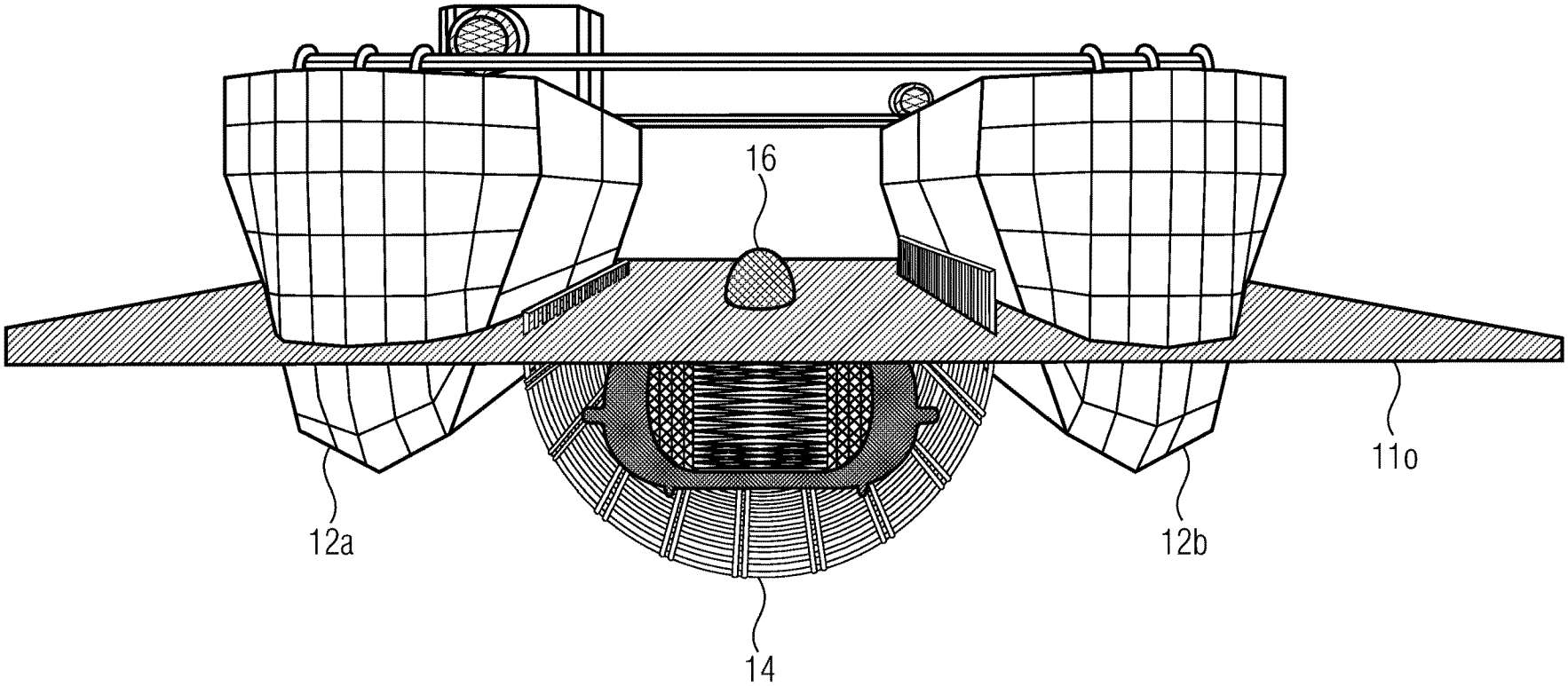

With reference to FIGS. 2*a* and 2*b*, the pull-in process will be discussed.

FIG. 2*a* shows the recovery apparatus 10' with the two hulls 12*a* and 12*b* and the net 14 arranged in the gap 12*z*, which is in the lowered position. This lowered position can, in particular, be seen in FIG. 2*b* which shows the net 14 floating in a U-shape between the two hulls under the water surface 110. Here, the "draft" of the net 14 is selected such that the AUV 16 can pull-in safely.

For ensuring the distance between the hulls 12*a* and 12*b*, the same are rigidly connected to one another by means of rods 12*s*1 and 12*s*2. Thus, sufficient space is provided in the gap 12*z* for the AUV 16, not only in the depth direction but also in the width direction.

In the next step, as already discussed with reference to FIGS. 1*a* and 1*b*, the fixed net 14 of the catamaran 10 or the SWATH 10 is lifted in a motor-driven manner, i.e., for example by means of winches, in order to lift the AUV 16 out of the water, i.e., above the water surface 110.

With reference to FIG. 3*a*-3*f*, optional features of the recovery apparatus 10' illustrated in FIGS. 2*a* and 2*b* will be discussed.

Figure 3A:
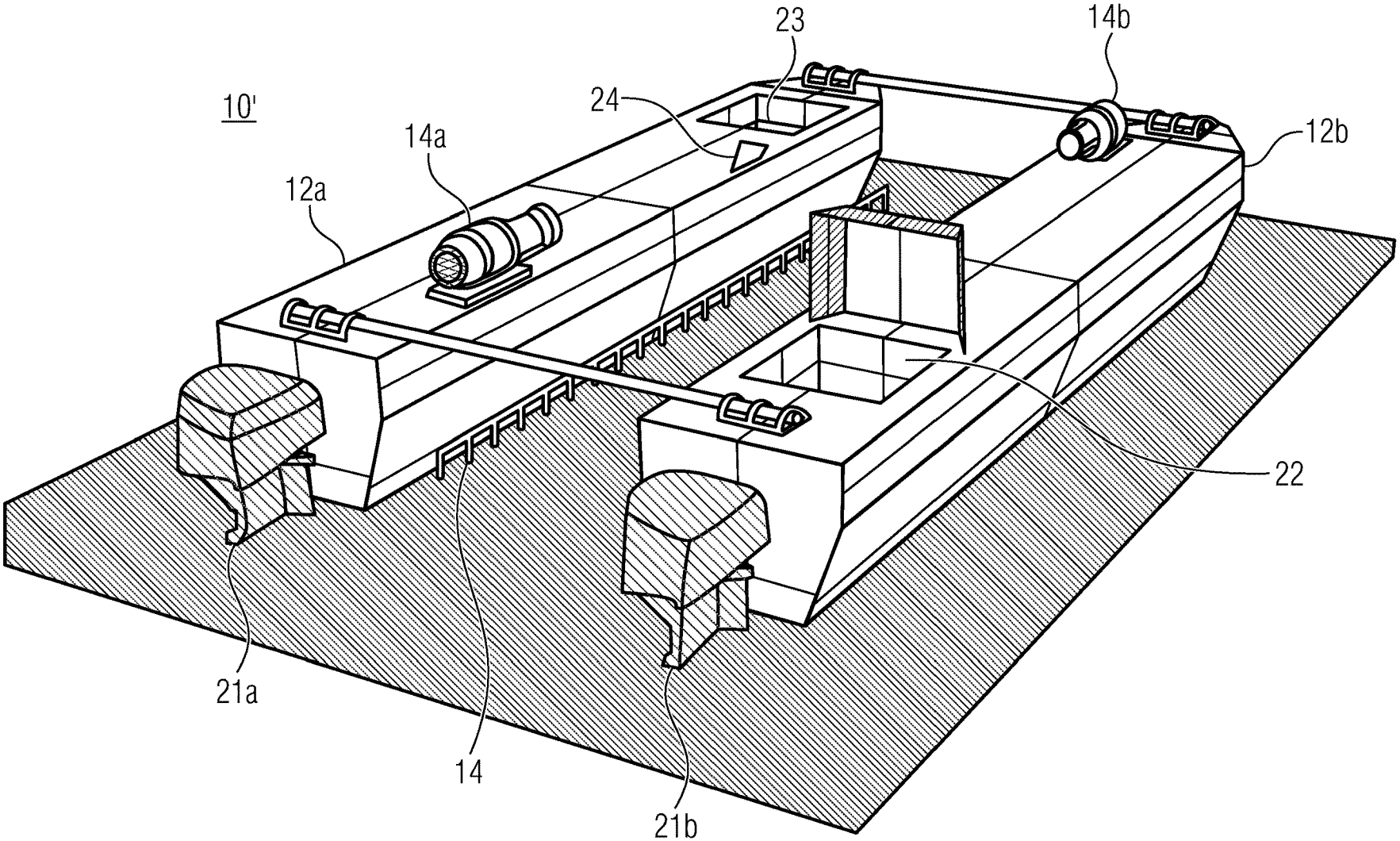
FIGS. 3*a-f* are further illustrations of the embodiment of FIGS. 2*a* and 2*b* for illustrating optional features.
Figure 3B:
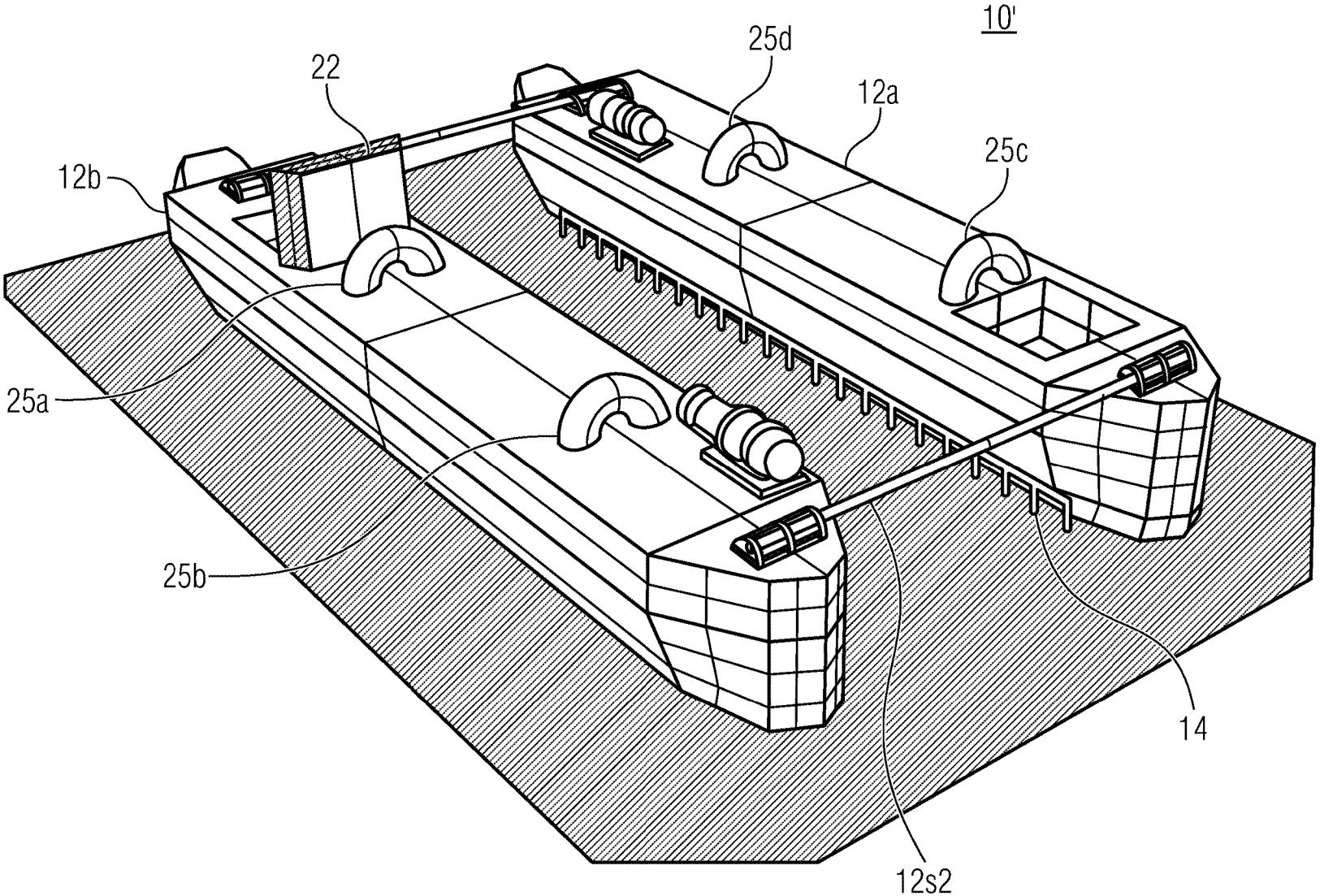
Figure 3C:
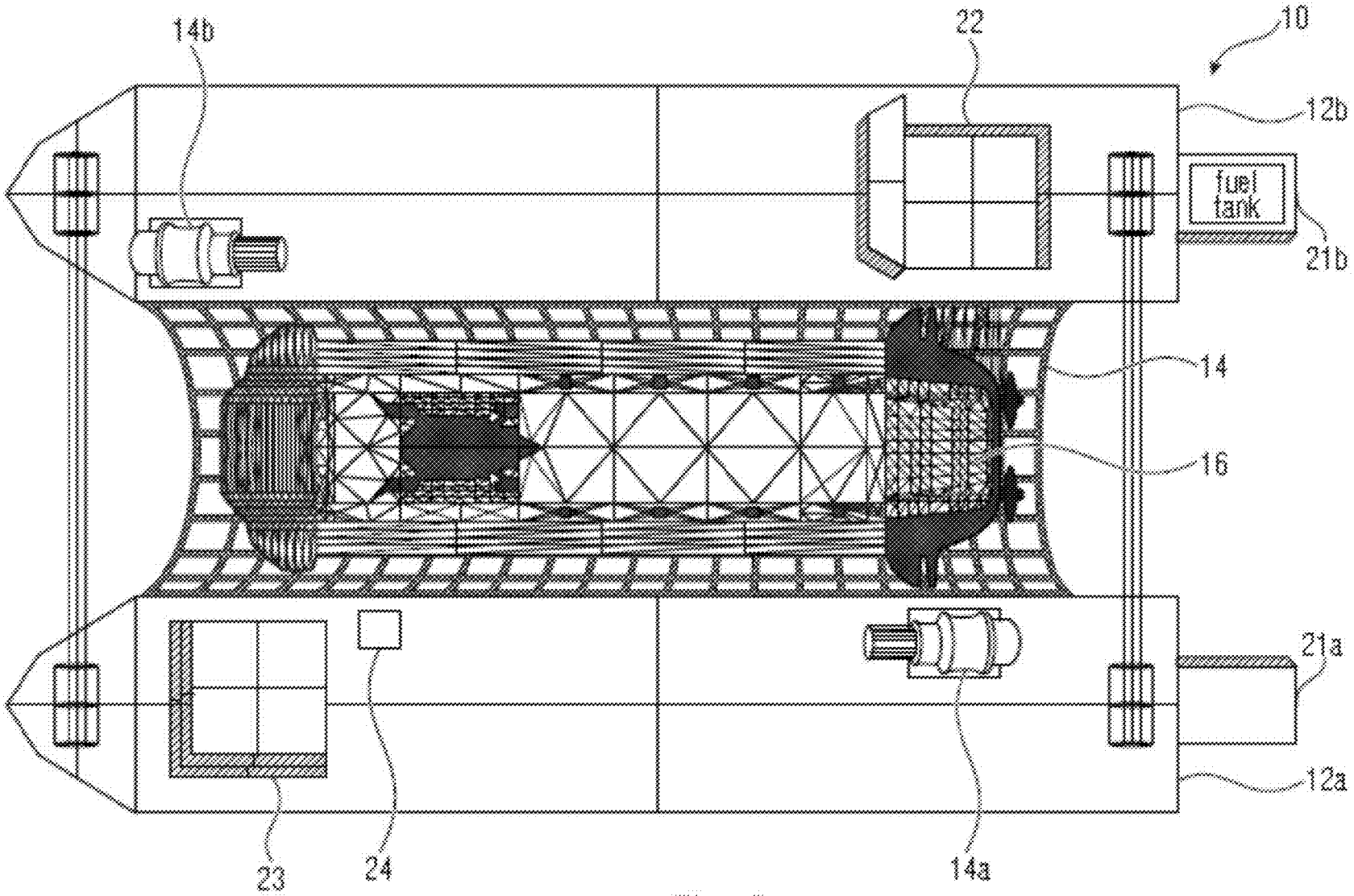
Figure 3D:
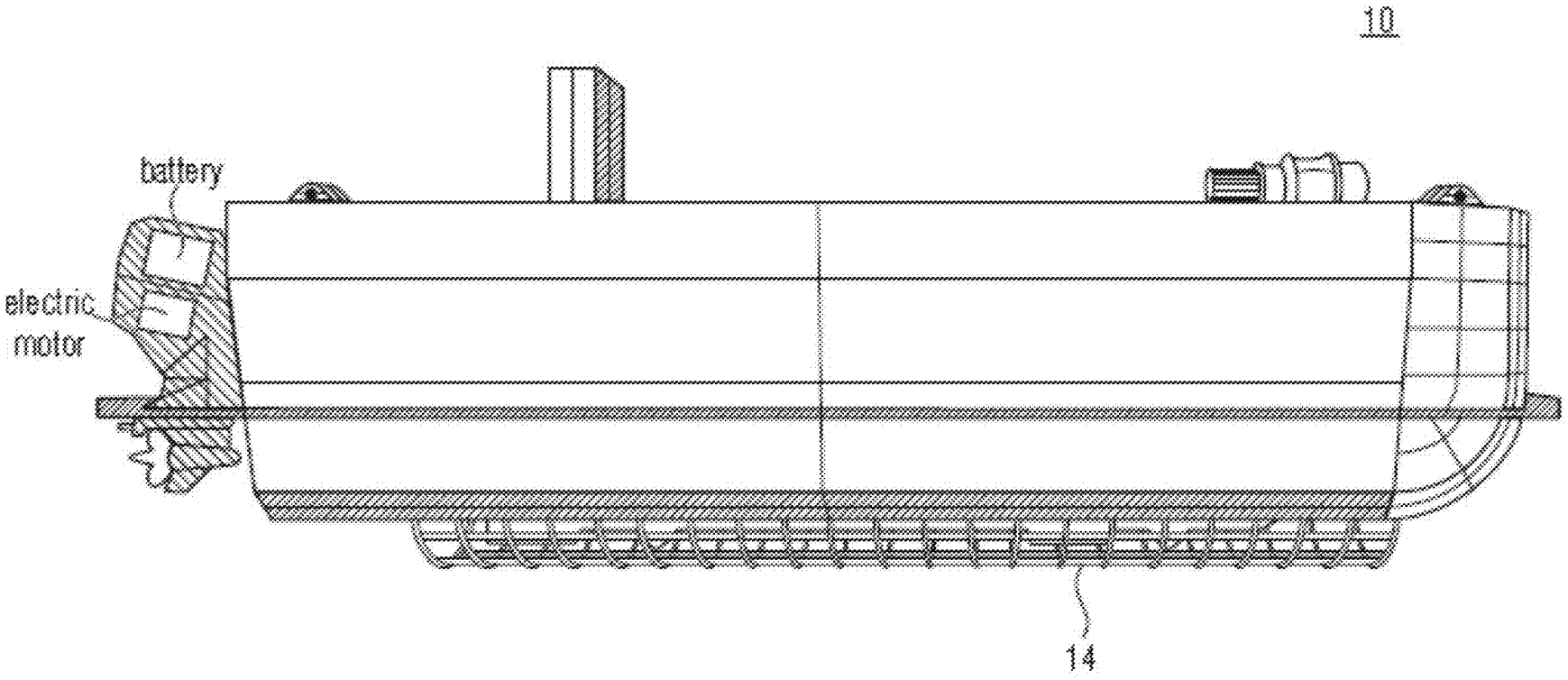
Figure 3E:
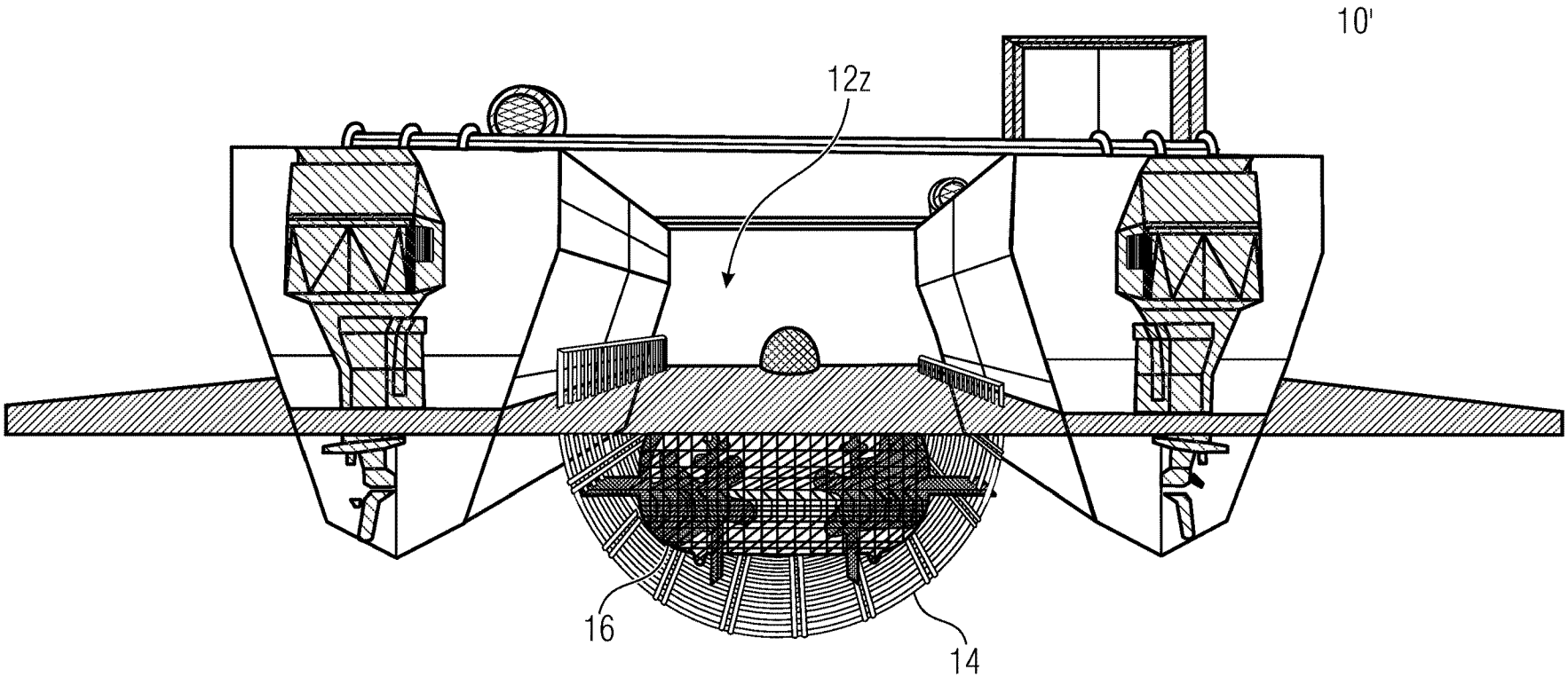

FIGS. 3*a* and 3*b* show three-dimensional illustrations of the recovery apparatus 10', wherein 3*a* shows the stern view and 3*b* the bow view. The recovery apparatus 10' has, for example, the dimensions LOA 5 m×LPP 4.5 m, B 2.786 m, T 0.430 m, at Δ 1.45 m3, D 1.05 m. This results in an overall weight of 1.584 t.

In FIGS. 3 and 3*b*, the net 14 is lowered. FIG. 3*c* shows a top view, 3*d* a side view and 3*e* a stern view of the recovery apparatus 10', wherein the autonomous underwater vehicle 16 is each already pulled into the gap 12*z*. As can be seen in FIG. 3*a*, the recovery apparatus 10' is motor-driven and comprises one drive motor 21*a* and 21*b* on each hull side (12*a* and 12*b*), here two outboard motors (e.g., two 15 PS engines or electric drives in combination with batteries or accumulators). This outboard motor can either be pivotable in order to allow oar functionality or can also simply be controlled differently with respect to its output power in order to allow maneuvering of the recovery apparatus 10'.

Further, according to further embodiments, the recovery apparatus 10' comprises a control station 22 by means of which the recovery apparatus 10' can be controlled (i.e., maneuvered and the recovery process can be performed). For this, a second control station, such as the control station 23 provided on the bow side for a second member of the ship crew can be provided, which retracts, for example, the AUV into the gap 12*z*.

For retracting, a winch 24 can be provided, by means of which a rope of the AUV 16 can be caught and pulled in. Starting from this, the recovery process is as follows:

Catamaran 10' is lowered into the water
AUV ejects "pop-up nose"
Catamaran 10' approaches the floating rope
Boatman catches the floating rope with a boat hook
Boatman guides the rope between the hulls
Boatman retracts AUV 16 into recovery position between the hulls
With the winches, the net under the AUV 16 is lifted up and the AUV 16 is lashed in storage position
The catamaran 10' drives back to the mother ship
The catamaran 10' is mounted to the crane and recovered
The hulls of the catamaran 10' protect the AUV from knocking against the ship wall.

In this embodiment, two winches 14*a* and 14*b* for lifting and lowering the net are provided. Each winch 14*a* and 14*b* can have a lifting capacity of 4.3 t.

According to further embodiments, each bow 12*a* and 12*b* comprises two eyes by means of which the catamaran 10' can be recovered onto the mother ship. These eyes 25*a-d* are illustrated in FIG. 3*b*.

Figure 3F:
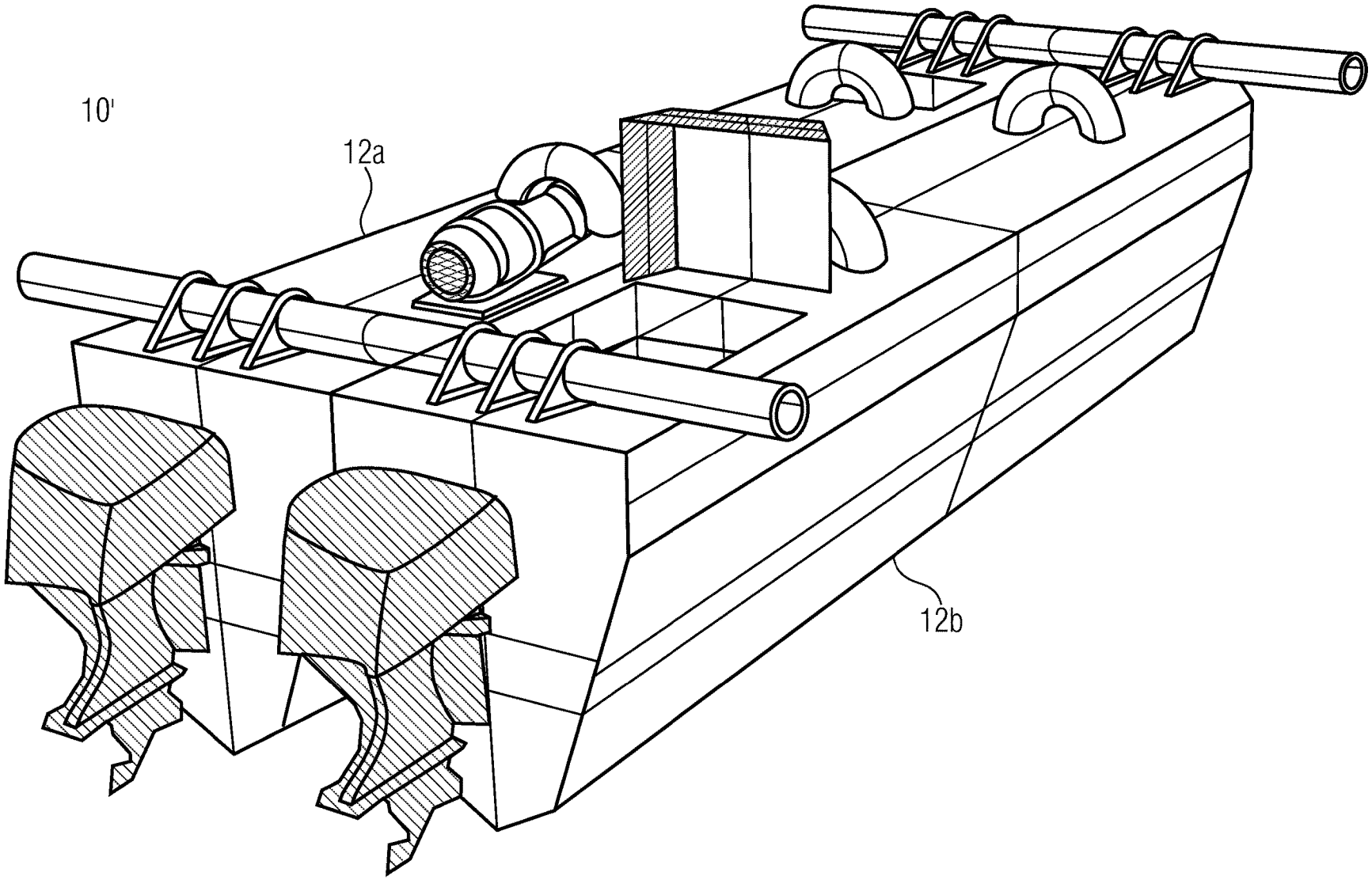

According to further embodiments, when no AUV 16 is arranged in the gap 12*z*, the two hulls 12*a* and 12*b* can be pushed together as can be seen in FIG. 3*f*. Based on the catamaran shape, the recovery apparatus 10' is still safely within the water.

Figure 4:
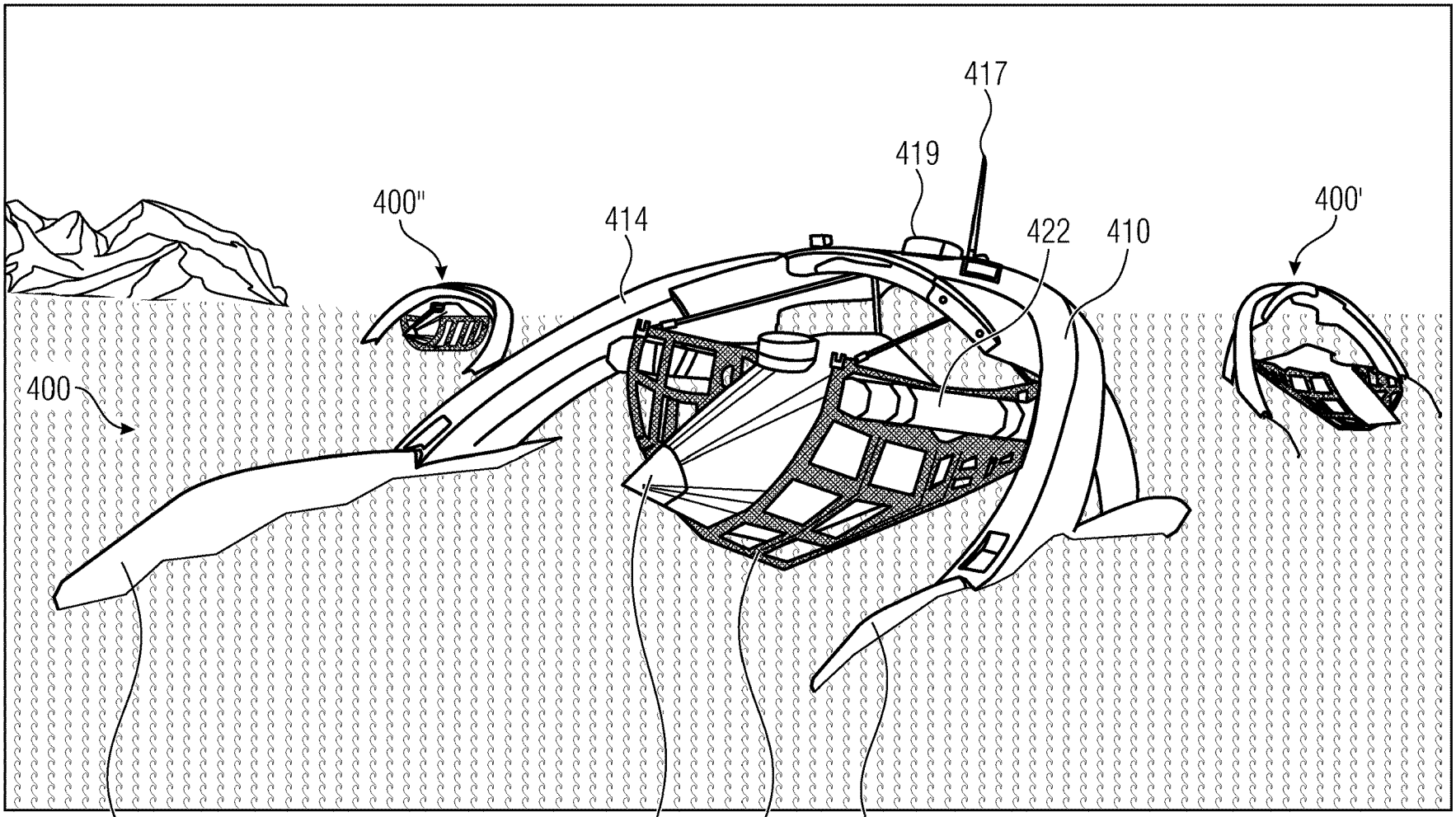
FIG. 4 is a schematic illustration of an autonomous recovery apparatus having an extended range.

FIG. 4 shows a system 400 including an autonomous recovery apparatus 410 as well as an autonomous underwater vehicle 420. The autonomous recovery apparatus 410 includes, like the recovery apparatuses discussed above, two hulls 412*a* and 412*b* that are connected to each other via a rod assembly 414. The net 416 or generally the catching means 416 for the autonomous underwater vehicle 420 are provided at the rod assembly 414. In this embodiment, the net 416 also comprises optional pivoting bodies 422.

The autonomous recovery apparatus 410 includes a sufficiently large dimensioned drive (not illustrated) as well as respective control means (not illustrated).

Sufficiently dimensioned drive means that the range of this recovery apparatus is extremely extended. The range can be several hundred kilometers or several hundred nautical miles, but at least 1, 5 or 12 nautical miles. The advantageous case is a radius of action in the range of 50 or 500 nautical miles starting from the pier, e.g., a pier at land. For the recovery apparatus 410 not being dependent on radio operation, the control can be configured to control the autonomous recovery apparatus 410 autonomously or at least semi-autonomously. This means that the control maneuvers the recovery apparatus 410 carrying the autonomous underwater vehicle 420 (above the water line) from takeoff until the operating site of the autonomous underwater vehicle 420 and then, according to extended embodiments, even launches the underwater vehicle 420 autonomously or semi-autonomously. Further, the recovery apparatus 410 can be configured to again recover the underwater vehicle 420 autonomously or semi-autonomously accordingly. Here, the system 400' in the background should be noted, which shows a recovery apparatus in combination with an autonomous underwater vehicle during the launch.

During the mission of the autonomous underwater vehicle 420, the recovery apparatus 410 can also support communication and/or navigation of the autonomous underwater vehicle 420. In other words, this means that the autonomous recovery apparatus 410 can forward navigation signals and/or radio signals from or to the autonomous underwater vehicle 420. Here, reference is made to the system 400" showing a recovery apparatus at the time when the autonomous underwater vehicle is on a mission while the recovery apparatus waits in the field of the mission until the recovery.

According to further embodiments, the recovery apparatus 410 comprises communication means 417 in order to be able to communicate with a base station, such as a base station at land. Via this antenna 417, for example, control data for the recovery apparatus 410 and/or for the autonomous underwater vehicle 420 are exchanged. This antenna 417 is mounted, for example, on the rod assembly 414. Additionally, the recovery apparatus 410 can also comprise a GPS antenna 419. The GPS antenna 419 serves for positioning the recovery apparatus 410 and/or for positioning the autonomous underwater vehicle 420.

The recovery apparatus 410 and/or the AUV 420 can be structured like the units/systems discussed with reference to FIGS. 1*a* to 3*f*.

Even when it has been presumed in the above embodiments that the AUV 420 is transported above or at least on the water surface, it should be noted that this is not mandatory. According to embodiments, the AUV 420 can be hauled by the recovery apparatus 410 on or under the water surface. For this, the above-discussed pop-off-nose principle can be used. This means that the AUV 420 has such a pop-off-nose or other means for engaging in the recovery apparatus 410 which is then caught by respective means for launch and recovery, such as a fork below water. Then, the AUV 420 is hauled across the distance by the (autonomous) recovery (and transport) apparatus 410 via this connection (pop-off-nose—fork).

In further embodiments, the recovery apparatus 10' can comprise transmitters, and receivers, e.g., allocated to a hydrophone (not illustrated) arranged below the water surface 110, which enable support of positioning the AUV during diving operation. The concept USBL (ultra-short baseline) or LBL (long baseline) offers a basis for such systems are offered by According to further embodiments, for positioning the recovery apparatus 10', the recovery apparatus 10' can itself comprise a GPS antenna by means of which the position in water can be determined. This GPS antenna or positioning serves to support positioning of the AUV during diving operation that the position of the recovery apparatus 10' is known from which the signals for underwater positioning can be transmitted and received.

According to further embodiments, the recovery apparatus 10' can also be unmanned and can be controlled, for example, via a radio or cable connection from the mother ship. Alternatively, it would also be possible that autonomous control of the recovery apparatus is possible.

According to further embodiments, the recovery apparatus 410 can be configured to charge the autonomous underwater vehicle 420, i.e., to supply the same with electric energy.

Even when it has been assumed in the above embodiments that two drive machines serving for control are provided simultaneously, it should be noted that essentially one drive machine is sufficient which can be combined with an oar. Alternatively, pod drives would also be possible.

With reference to the above-stated embodiments, it should be noted that the same have been described in the context of an apparatus, wherein further embodiments provide a respective method. A description of the individual features of the apparatus descriptions also represents a respective description of the features for the allocated method steps.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Autonomous system comprising an autonomous underwater vehicle and an autonomous recovery apparatus for the autonomous underwater vehicle, comprising:

a drive of autonomous recovery apparatus, wherein the drive is implemented as part of the autonomous recovery apparatus and is configured to transport the autonomous recovery apparatus together with the autonomous underwater vehicle across a range, wherein the range is a range of more than 5 nautical miles;

a unit for launch and recovery of the autonomous underwater vehicle, wherein the recovery apparatus is configured to be operated in an autonomous manner;

wherein the autonomous underwater vehicle is configured to be operated independent from the recovery apparatus;

wherein the autonomous recovery apparatus comprises a sensor system as well as a control unit, wherein the control unit is configured to perform semi-autonomous or autonomous control of the recovery apparatus based on data from the sensor system and wherein the control unit is configured to autonomously launch and/or recover the autonomous underwater vehicle; and wherein the recovery apparatus comprises two hulls and a net arranged between the two hulls for receiving the autonomous underwater vehicle, wherein the net can be lowered from a non-lowered state of the net to a lowered state of the net where the net floats below the water surface such that the autonomous underwater vehicle can be launched and received in the lowered state and can be transported in the non-lowered state.

2. Autonomous system according to claim 1, wherein the drive comprises a combustion engine for moving the recovery apparatus as well as a fuel tank having a holding capacity for the range.

3. Autonomous system according to claim 1, wherein the drive comprises an electric motor for moving the recovery apparatus.

4. Autonomous system according to claim 3, wherein the recovery apparatus comprises a battery having a capacity for the range and/or a generator in combination with a fuel tank having a holding capacity for the range.

5. Autonomous system according to claim 3, wherein the recovery apparatus comprises an energy generator.

6. Autonomous system according to claim 1, wherein the recovery apparatus comprises a controller for controlling an oar, at least a rotatable drive pod and/or in the form of two juxtaposed ship propellers.

7. Autonomous system according to claim 1, wherein the control unit is configured to dock the recovery apparatus autonomously at land and/or at a pier and/or at a mother ship.

8. Autonomous system according to claim 1, wherein the recovery apparatus comprises a GPS receiver or GNSS receiver as sensor system.

9. Autonomous system according to claim 1, wherein the recovery apparatus comprises a repeater that is configured to forward navigation signals and/or control signals to the autonomous underwater vehicle.

10. Autonomous system according to claim 1, wherein the recovery apparatus is configured to supply the autonomous underwater vehicle with electric energy for charging the autonomous underwater vehicle.

11. Autonomous system according to claim 1, wherein the recovery apparatus comprises a position determiner and/or a transmitter arranged underwater and a receiver arranged underwater and/or a hydrophone arranged underwater such that the position of the autonomous underwater vehicle can be determined during a diving operation.

12. Autonomous system according to claim 1, wherein the recovery apparatus comprises a controller for controlling a rotatable drive pod.

13. Autonomous system according to claim 1, wherein the recovery apparatus comprises a controller for controlling two juxtaposed ship propellers.

* * * * *